US009982874B2

(12) United States Patent
Skiba

(10) Patent No.: US 9,982,874 B2
(45) Date of Patent: May 29, 2018

(54) MODULAR ILLUMINATING DEVICE

(71) Applicant: Krzysztof Skiba, Bielsko-Biała (PL)

(72) Inventor: Krzysztof Skiba, Bielsko-Biała (PL)

( * ) Notice: Subject to any disclaimer, the term of this patent is extended or adjusted under 35 U.S.C. 154(b) by 0 days. days.

(21) Appl. No.: 15/070,202

(22) Filed: Mar. 15, 2016

(65) Prior Publication Data

US 2016/0290610 A1 Oct. 6, 2016

(30) Foreign Application Priority Data

Mar. 18, 2015 (PL) ..... 411633

(51) Int. Cl.
*F21V 21/00* (2006.01)
*F21S 4/00* (2016.01)
(Continued)

(52) U.S. Cl.
CPC ..... *F21V 21/005* (2013.01); *F21S 8/06* (2013.01); *F21V 15/01* (2013.01); *F21V 17/164* (2013.01); *F21V 19/0035* (2013.01); *F21V 23/02* (2013.01); *F21V 23/06* (2013.01); *F21V 29/70* (2015.01); *F21V 29/89* (2015.01);
(Continued)

(58) Field of Classification Search
CPC ..... F21V 21/005; F21V 29/70; F21V 29/89; F21V 15/01; F21V 17/164; F21V 19/0035; F21V 23/02; F21V 23/06; F21S 8/06
See application file for complete search history.

(56) References Cited

U.S. PATENT DOCUMENTS 8,841,690 B1 * 9/2014 Kim ..... H01L 33/483 257/100
2010/0277908 A1 * 11/2010 Hu ..... F21V 15/01 362/235

(Continued)

FOREIGN PATENT DOCUMENTS

CN 102 76 7726 A 11/2012
KR 101 502 949 B1 3/2015

(Continued)

*Primary Examiner* — Laura Gudorf
(74) *Attorney, Agent, or Firm* — Horst M. Kasper, Esq.

(57) ABSTRACT

A modular illuminating device comprises at least one frame (1) with the front elastic catches (2) for securing a transparent cover (4) to the frame (1), and the rear elastic catches (3) for fixing the frame (1) to a printed-circuit board (5) with at least one printed circuit module (6) and at least one light-emitting diode module (7) on its front side. The printed-circuit board (5) has multiple equally spaced assemblies comprised of the printed circuit modules (6) and LED modules (7), arranged in a row, or a rectangular matrix, or a honeycomb structure. The power line is printed along the printed-circuit board (5) with offtakes to individual printed circuit modules (6) and LEDs modules (7). Alternatively, the printed power line supplies the AC/DC converter placed at one end of the printed-circuit board (5), and the AC/DC converter supplies individual printed circuit modules (6) and LEDs modules (7) with constant voltage via another pair of leads printed along the printed-circuit board (5). The printed-circuit board (5) comprises an aluminum radiator, preferably an aluminum plate (8), placed at its rear side. The aluminum plate (8) can be pained or printed with a layer of paint and/or a polymer film, on all or part of its rear surface.

17 Claims, 3 Drawing Sheets

(51) Int. Cl.

| | |
|---|---|
| ***F21V 21/005*** | (2006.01) |
| ***F21V 15/01*** | (2006.01) |
| ***F21V 17/16*** | (2006.01) |
| ***F21V 19/00*** | (2006.01) |
| ***F21V 29/70*** | (2015.01) |
| ***F21V 29/89*** | (2015.01) |
| ***F21S 8/06*** | (2006.01) |
| ***F21V 23/02*** | (2006.01) |
| ***F21V 23/06*** | (2006.01) |
| *F21V 31/00* | (2006.01) |
| *F21V 3/02* | (2006.01) |
| *F21Y 105/10* | (2016.01) |
| *F21Y 115/10* | (2016.01) |

(52) U.S. Cl.

CPC ..... *F21V 3/02* (2013.01); *F21V 31/005* (2013.01); *F21Y 2105/10* (2016.08); *F21Y 2115/10* (2016.08)

(56) References Cited

U.S. PATENT DOCUMENTS

2013/0194806 A1* 8/2013 Smith ..... F21V 21/14 362/249.03
2016/0186968 A1* 6/2016 Edwards ..... F21K 9/64 362/84
2016/0356470 A1* 12/2016 Noh ..... F21V 21/005

FOREIGN PATENT DOCUMENTS

PL 404 058 A1 12/2014
PL 404 060 A1 12/2014

* cited by examiner

MODULAR ILLUMINATING DEVICE

BACKGROUND OF THE INVENTION

(1) Field of the Invention

The present invention refers to a modular lighting device used for single- or multi-point light source devices, e.g. the ceiling light modules or luminescent panels, intended to illuminate the interior of buildings. The invention is particularly suitable for light-emitting diodes (LED sources). Application of the invention for outdoor illumination is equally possible.

Recent years have been a time of tremendous growth of the industry producing LED-based lamps or lighting panels for various applications. The LED sources emit intense, bright and close to natural light. Moreover, the lamp lifetime using the LEDs is much longer than for previously applied light sources. Durability of LEDs is estimated to 30-40 thousand hours, and they are resistant to frequent switching on and off. Mean time of their use is in practice several years. Due to the advantages of LEDs, energy efficiency, high index of color reproduction, durability, or limited heating, they are increasingly used in all areas of the house: the kitchen, living room, bedroom, etc. They have successfully entered the office buildings as well.

(2) Description of Related Art Including Information Disclosure Under 37 CFR 1.97 and 1.98

Chinese patent document CN102767726 (A) discloses a LED signal lamp comprising at least one white LED and at least one optical filter arranged in the light path to produce at least partially color light. The lamp diffuser is fixed to the support as well as electronic and optical parts.

Korean patent KR101502949 (B1) describes a LED lighting apparatus for mounting on a ceiling, in which a LED panel and a power supply module are spaced apart from each other, thereby preventing too high increase of internal temperature. The LED lighting apparatus comprises: a frame horizontally fixed to a ceiling surface, in which a downward opened space portion is formed, and which includes a LED panel fastened to the space portion; a diffuser plate which is fastened to a lower portion of the fixing frame, and covers the opened space portion and diffuses light emitted downward from the LED panel; a partition which is extended upward at a predetermined length along an upper edge of the fixed frame and in which a space is formed between the ceiling surface and an upper surface of the fixed frame; and a power supply module.

Polish patent application PL404058 (A1) discloses a luminaire using LEDs, designed to light the spaces inside buildings and for outdoor lighting. The lighting device has a light diffuser which is a housing for combined the mounting plate fitted with LEDs, and a radiator. The light diffuser has a spherical cap connected with a cylindrical part. The latter has two resilient tabs disposed on opposite sides of its circumference for fixing it to an external housing, and the recesses to receive the protrusions of the mounting plate. LEDs are located in and around a center of the mounting plate.

Another Polish patent application PL404060 (A1) also proposes a LED illumination device designed to illuminate indoor and outdoor space. The light diffuser is connected to the mounting plate combined with a radiator. Spherical cap of the light diffuser has four equally spaced elastic tabs provided with rectangular openings for projections of the mounting plate. LEDs are located in and around central portion of the mounting plate.

None of known solutions is designed especially for modular LED-based lighting devices. The so called modular lamps known so far are indeed individual lamps which can be arranged side by side. An example of such a concept is disclosed in American patent U.S. Pat. No. 6,361,186 (B1), wherein the translucent diffuser is held in longitudinally aligned abutment against the edges of the housing slot. A plurality of light emitting diodes is aligned in a linear array in a chamber between the housing and the diffuser. The housing is hidden behind the diffuser. The diodes may be electrically connected in patterns of alternating sequential activation to give a flashing, mono-chromatic effect and may be color coded according to the patterns of alternating sequential activation to give a flashing, color changing effect to the fixture. Individual lamps can be constructed in modular lengths. Alternatively, long lengths of light can be cut to any desired length. In addition, connectors of a wide range of angles, e.g. 90 degrees, may be used to interconnect straight modules into a desired configuration.

Another example of the same approach is proposed in American patent application US2011038147 (A1) which describes an assembly structure for a LED lamp that includes a cover plate, a LED module, fasteners and a mask. An inner surface of the cover plate is provided with a fixing portion, while its both sides are formed with the slots for mounting the LED module consisting of a plurality of LEDs mounted on the substrate. The substrate is provided with an insertion hole. One end of the fastener is detachably connected into the insertion hole of the substrate and the other end thereof is fixed to the fixing portion. The mask is made of transparent materials and has an accommodating space for allowing the LED module to be disposed therein. Both sides of the mask defining the accommodating space are formed with a locking flange for inserting into the slot of the cover plate. Individual lamps are provided with plugs and sockets at the opposite ends to enable making a line of directly connected lamps.

While both above-mentioned American patent documents deal with linear light sources, the German utility model application DE202013103294 (U1) proposes rectangular panels of planar light sources that may be arranged side by side. A singular panel comprises an LED board and a light-permeable cover that is held on the LED circuit board via a latching connection. No interconnection between individual panels is provided.

The aim of the invention is to propose a really modular solution making possible to design a single or multiple lamp, according to individual choice of the lighting technician.

DETAILED DESCRIPTION OF THE INVENTION

A modular illuminating device according to the invention comprises at least one frame which has front elastic catches for securing a transparent cover to the frame, and rear elastic catches for fixing the frame to a printed-circuit board with at least one module of printed circuit and at least one LED module on its front side. The light diffusing part of the transparent cover can be flat, cylindrical, or spherical cap. Obviously, other decorative, e.g. irregular shapes can be applied.

The printed-circuit board has multiple equally spaced assemblies comprised of the printed circuit and LED modules, arranged in a row, or a rectangular matrix, or a honeycomb structure. Repetitive opto-electronic structure of the printed-circuit board enables the technician to cut a strip of the printed-circuit board as long and wide as needed, and then to fix adequate number of frames to this strip. The power line can be printed along the printed-circuit board with offtakes to individual printed circuit and LEDs modules. Alternatively, the printed power line can supply the AC/DC converter placed at one end of the printed-circuit board, and this converter supplies individual printed circuit and LEDs modules with constant voltage via another pair of leads printed along the board.

The printed-circuit board with LEDs is equipped on its rear side with an aluminum radiator, preferably an aluminum plate. This plate is a heat-sink for the opto-electronic circuit.

The aluminum plate is coated with a layer of paint and/or a polymer film on all or part of its rear surface. In particular said layer of paint and/or the polymer film can be printed on rear surface.

Preferably the outer profile of the frame is rectangular, e.g. square, however other shapes can be applied as well, like round, elliptic, etc. It can also be shaped in a puzzle-like way, i.e. with completive, e.g. convex-concave sections.

Two or more frames connected by the board make an assembly. They can be connected in series, a rectangular array, or a honeycomb structure.

Claimed modular illuminating device comprises also a housing plate with an opening, the edge of which is located between the frame and the transparent cover. A sealing ring is placed between the transparent cover and the housing plate. The device comprises also the fastening elements for mounting in or on a wall, ceiling or floor, or for suspending it under the ceiling.

BRIEF DESCRIPTION OF THE SEVERAL VIEWS OF THE DRAWINGS

An exemplary embodiment of the device according to the invention is shown in the drawings:

As illustrated in FIGS. 1 and 2 the modular lighting device according to the invention comprises at least one rectangular frame 1 with the front elastic tabs 2 and the rear elastic tabs 3. The front elastic tabs 2 are used to catch the transparent cover 4, while the rear elastic tabs 3 are used for fixing the frame 1 to the board 5 with printed circuit 6 and the light-emitting diodes 7. The printed-circuit board 5 has an aluminum plate 8 on its rear side. The aluminum plate 8 is covered with a layer of paint and/or a polymer film on the whole or part of its surface. Alternatively, the layer of lacquer and/or the polymer film can be printed instead of painting over all or part of rear surface of the aluminum plate. The frame 1 and the transparent cover 4 are fixed together in the opening 9 shaped in the housing plate 10. A sealing ring 11 placed around the edge of the opening 9 and between the transparent cover 4 and the housing plate 10 secures the inside of the lamp from dust, humidity, small insects, and the like.

FIG. 3 shows that a number of frames 1 can be combined into an assembly by means of one or more printed-circuit boards 5. Here the lamp modules are combined in a row and a rectangular array. The printed-circuit boards 5 have repetitive structure of equally spaced modules comprised of the printed circuits 6 and LEDs 7.

Figure 1:
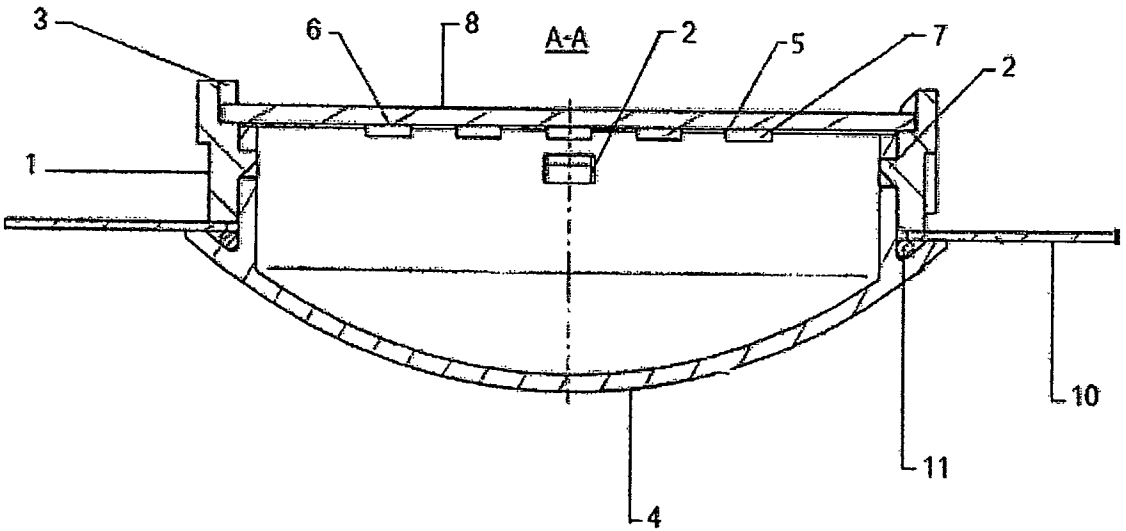
FIG. 1 shows a cross section of the lighting device.
Figure 2:
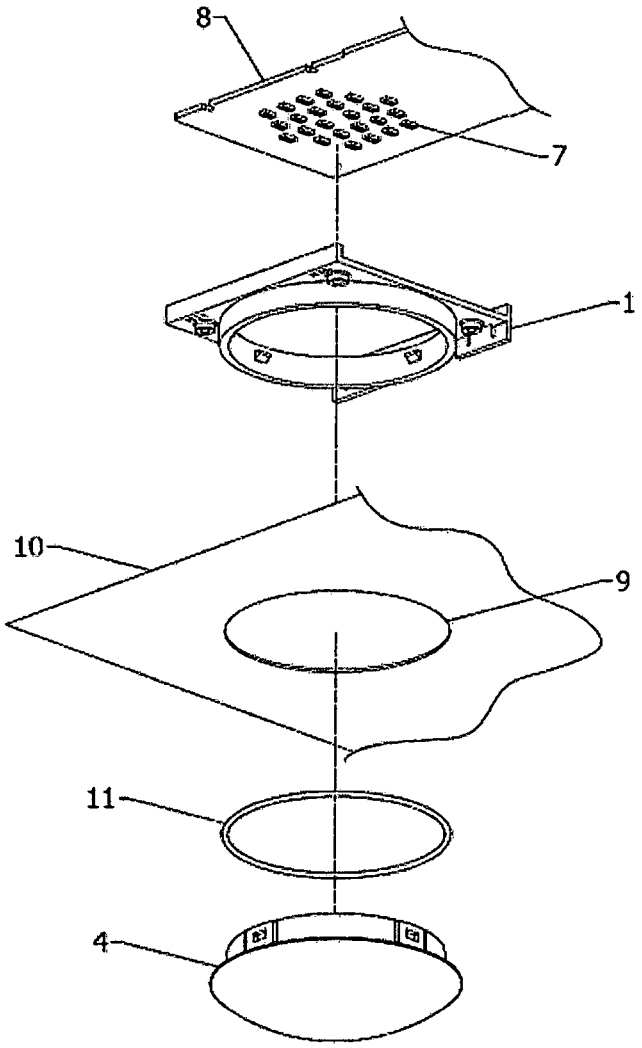
FIG. 2 shows its components in exploded view.
Figure 3:
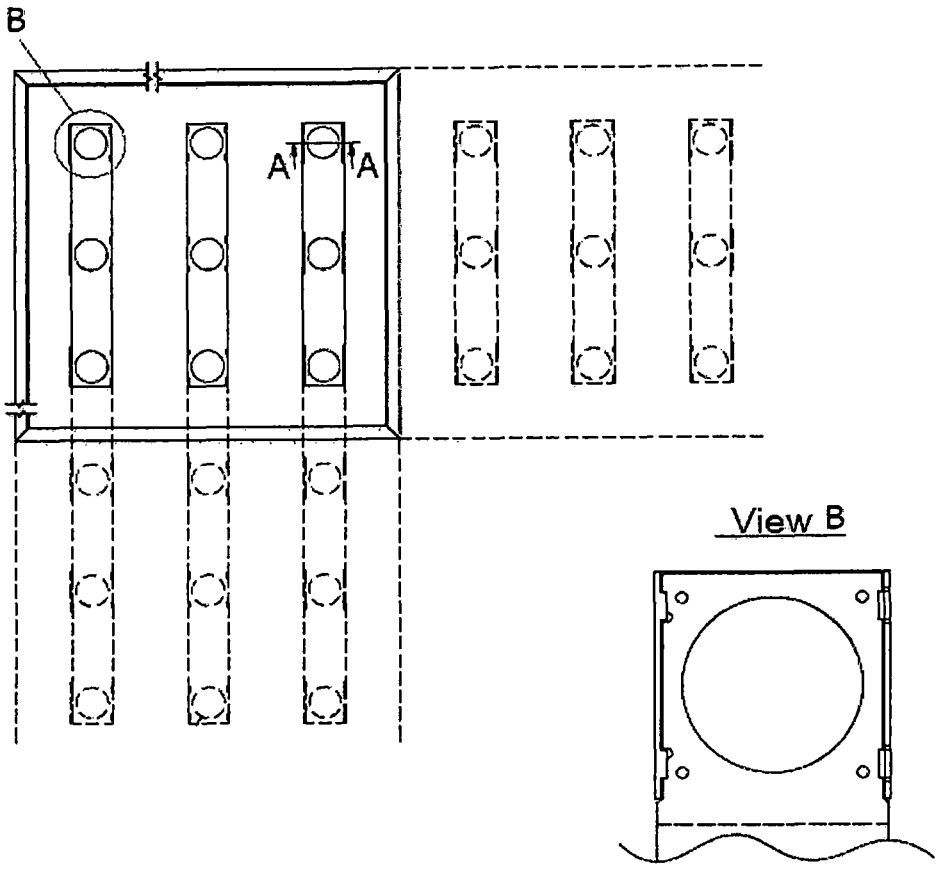
FIG. 3 shows examples of modular structure of the illuminating device.

The invention claimed is:

1. A modular illuminating device, characterized in that said device comprises at least two frames (1), each frame (1) having front elastic catches (2) for securing a transparent cover (4) to the frame (1), and rear elastic catches (3) for fixing the frame (1) to a printed-circuit board (5), common for at least two frames (1) and having at least one printed circuit module (6) and at least one light-emitting diode module (7) located on a front side of the printed-circuit board (5) at areas that coincide with the transparent cover (4), and in that said device further comprises a housing plate (10) with at least two openings (9), wherein an edge of each opening is located between the frames (1) and the transparent cover (4).

2. The device according to claim 1, characterized in that the printed-circuit boards 5 has multiple spaced assemblies comprised of the printed circuit modules (6) and LED modules (7), arranged in a row, or a rectangular matrix, or a honeycomb structure.

3. The device according to claim 1, characterized in that a power line is printed along the printed-circuit board (5) with offtakes to individual printed circuit modules (6) and LEDs modules (7), or the printed power line supplies an AC/DC converter placed at one end of the printed-circuit board (5), and the AC/DC converter supplies individual printed circuit (6) and LEDs modules (7) with constant voltage via another pair of leads printed along the printed-circuit board (5).

4. The device according to claim 1, characterized in that the printed-circuit board (5) comprises an aluminum radiator, at the rear side opposite to the one with the light-emitting diodes (7).

5. The device according to claim 1, characterized in that the aluminum radiator has a form of an aluminum plate (8).

6. The device according to claim 1, characterized in that all or part of the surface of the aluminum plate (8) is coated with a layer of paint and/or a polymer firm.

7. The device according to claim 1, characterized in that a layer of paint and/or the polymer film is printed over all or part of the surface of the aluminum plate (8).

8. The device according to claim 1, characterized in that an outer profile of the frame (1) is rectangular.

9. The device according to claim 1, characterized in that at least two frames (1) connected by the board (5) make an assembly.

10. The device according to claim 1, characterized in that the frames (1) are connected in series.

11. The device according to claim 1, characterized in that the frames (1) are connected in a rectangular array.

12. The device according to claim 1, characterized in that the frames (1) are connected in a honeycomb structure.

13. The device according to claim 1, further comprising a sealing ring (11) placed between the transparent cover (4) and the housing plate (10).

14. The device according to claim 1, further comprising fastening elements for mounting in a wall, ceiling or floor.

15. The device according to claim 1, further comprising a fastening means for suspending under a ceiling.

16. The device according to claim 1, characterized in that the printed-circuit board (5) comprises an aluminum radiator, in the form of an aluminum plate (8), on the rear side opposite on the rear side opposite to the one with the light-emitting diodes (7).

17. The device according to claim 1, characterized in that the aluminum plate (8) is coated with a layer of a polymer film on all or part of a surface.

* * * * *